US005186235A

United States Patent [19]

Ward, Jr.

[11] Patent Number: 5,186,235

[45] Date of Patent: Feb. 16, 1993

[54] HOMOGENIZATION OF ALUMINUM COIL

[75] Inventor: Bennie R. Ward, Jr., Chesterfield County, Va.

[73] Assignee: Reynolds Metals Company, Richmond, Va.

[21] Appl. No.: 607,327

[22] Filed: Oct. 31, 1990

[51] Int. Cl.[5] ..... B22D 11/12

[52] U.S. Cl. ..... 148/552; 164/477; 164/476

[58] Field of Search ..... 164/476, 477, 76.1; 148/2

[56] References Cited

U.S. PATENT DOCUMENTS

| | | | |
|---|---|---|---|
| 2,670,309 | 2/1954 | McClintock et al. . | |
| 3,827,917 | 8/1974 | Ziegler et al. | 148/2 |
| 3,938,991 | 2/1976 | Sperry et al. | 148/2 |
| 3,944,439 | 3/1976 | Pryor et al. | 148/2 |
| 4,000,008 | 12/1976 | Chia . | |
| 4,000,009 | 12/1976 | Chatfield | 148/2 |
| 4,028,141 | 6/1977 | Chia et al. . | |
| 4,126,486 | 11/1978 | Morris et al. | 148/2 |
| 4,166,755 | 9/1979 | Fister, Jr. et al. | 148/2 |
| 4,569,703 | 2/1986 | Baba et al. . | |
| 4,699,673 | 10/1987 | Kobayashi et al. . | |
| 4,751,957 | 6/1988 | Vaught . | |
| 4,799,974 | 1/1989 | Mahoney et al. . | |
| 4,828,012 | 5/1989 | Honeycutt, III et al. . | |
| 4,896,715 | 1/1990 | Honeycutt . | |
| 4,927,470 | 5/1990 | Cho . | |
| 4,934,443 | 6/1990 | Honeycutt, III et al. . | |

FOREIGN PATENT DOCUMENTS

| | | |
|---|---|---|
| 89/09667 | 10/1989 | PCT Int'l Appl. . |
| 90/05604 | 5/1990 | PCT Int'l Appl. . |

*Primary Examiner*—Richard K. Seidel
*Attorney, Agent, or Firm*—Robert C. Lyne, Jr.

[57] ABSTRACT

Drag cast coils of aluminum metal are homogenized to achieve grain refinement by cooling said coil initially from a temperature of around 900° F. to ambient temperature under controlled conditions at a cooling rate ranging from about 5° F. per hour to 90° F. per hour.

12 Claims, 8 Drawing Sheets

ASTM 0

ASTM 3.5

ASTM 4

ASTM 4

ASTM 4

ASTM 4.5

ASTM 4

ASTM 4.5

ASTM 4.5

ASTM 5

ASTM 4.5

ASTM 4.5

HOMOGENIZATION OF ALUMINUM COIL

FIELD OF THE INVENTION

This invention relates to the homogenization of aluminum coil and more particularly relates to novel methods for the homogenization of aluminum coil cast from a drag casting operation and to the novel products produced thereby.

BACKGROUND ART

It is known to produce aluminum in coil form from a direct casting apparatus wherein molten aluminum is cast in the form of a metal strip and rolled into a coil on a coiler. Drag casting apparatus and methods of this type are described, for example, in U.S. Pat. Nos. 4,828,012, 4,751,957, 4,896,715, and 4,934,443 and in PCT publications WO89/09667, published Oct. 10, 1989, and WO90/05604, published May 31, 1990. The disclosures of these patents and PCT publications are hereby specifically incorporated by reference with respect to the methods for the production of aluminum strip in coiled form from molten aluminum.

Generally, in this process and apparatus, metal strip is directly cast from molten metal deposited on a moving chill surface from a tundish having an open outlet. An inlet is provided for the flow of molten metal into the tundish from a source of molten metal. Diverters within the tundish divide the flow of molten metal into a plurality of separate streams and divert one of the streams in the direction of each sidewall and for recombining the diverted streams into a composite stream flowing toward the outlet. Flow diffusers diffuse the molten metal flowing through the tundish to provide molten metal of substantially uniform temperature across the width of the tundish at the outlet. The tundish is cast onto a chill wheel, preferably a grooved chill wheel, at a rapid rate.

The aluminum strip produced from this direct casting apparatus is wound on a coiler in heated form. Generally, the temperature of the aluminum on the coiler will be in the range of about 900° F.

It is also known in the metal art that "as cast" material still requires refinement of grain structure or homogenization to provide a commercially acceptable product. There is substantial prior work in connection with metal stock to achieve refinement of the metal by thermal and annealing treatments. Various heat treatments have been utilized and are recognized in the aluminum art as useful to change the grain size and in effect homogenize the aluminum metal. Prior art of this type includes U.S. Pat. Nos. 4,000,008, 2,670,309, 4,028,141, 4,569,703, 4,699,673, 4,799,974, and 4,927,470. In general, these prior art patents disclose that aluminum may be treated thermally or by annealing to refine the grain structure.

None of these prior patents, however, are concerned with direct cast aluminum coils from a drag casting process.

The present invention provides a method for the refinement of aluminum metal and thus homogenization, of a coil of aluminum produced from a drag casting process.

SUMMARY OF THE INVENTION

It is accordingly one object of the present invention to provide a method for the production of commercially acceptable aluminum metal by effecting grain refinement or homogenization of the metal in coiled form.

A further object of the invention is to provide an aluminum metal in coiled form in which grain refinement and homogenization have been achieved to produce an aluminum coil product of improved properties.

Other objects and advantages of the present invention will become apparent from the following description.

In satisfaction of the foregoing objects and advantages, there is provided a method for the grain refinement and homogenization of a coil of aluminum, said aluminum coil being at a temperature in the range of about 900° F., which comprises slowly cooling said coil under controlled conditions at a cooling rate ranging from about 5° F. per hour to about 90° F. per hour.

Also provided by the present invention as an article of manufacture is an aluminum coil which has been cast at a temperature in the range of about 900° F. in coiled form and cooled to ambient temperature under controlled cooling conditions at a cooling rate ranging from about 5° F. per hour to about 90° F. per hour, said aluminum coil having improved grain refinement and homogenization characteristics as compared to the "as cast" form of the aluminum coil.

BRIEF DESCRIPTION OF DRAWINGS

Reference is now made to the drawings accompanying the application wherein.

DESCRIPTION OF PREFERRED EMBODIMENTS

The present invention is concerned with methods for the grain refinement of aluminum metal, preferably an aluminum alloy which has been cast in coil form at an elevated temperature and products produced therefrom. The coil has preferably been cast in a drag casting process. According to the present invention, it has been discovered that refinement of the grains of the aluminum metal can be achieved in a relatively simple manner while the aluminum remains in coiled form. In particular, the present invention is based on the discovery that grain refinement and thus homogenization, can be achieved by controlled cooling of the aluminum coil to ambient temperature at a cooling rate ranging from about 5° F. per hour to about 90° F. per hour. Optimum effects are achieved at cooling rates ranging from about 10° F. per hour to about 75° F. per hour, more preferably about 10° F. to 40° F. per hour.

The present invention also provides aluminum metal in coil form which has been cast at a temperature of about 900° F. and then cooled to a desired temperature such as ambient temperature, under controlled cooling conditions at a cooling rate ranging from about 5° F. per hour to about 90° F. per hour. This aluminum coil has an improved grain structure as compared to the direct cast product. In fact, the grain structure of the aluminum coil is improved so dramatically that it approaches commercial refinement.

In a conventional homogenization, a coil of aluminum is heated from room temperature to a predetermined temperature and then soaked at that temperature for a predetermined period of time. While it is known that grain refinement of aluminum metals can be achieved by a conventional or "formal" homogenization, it was unexpected that refinement of a coil of aluminum which had been cast at the unusually high temperature of about 900° F. could be achieved by a controlled cooling of the metal from the "as cast" temperature. It has been found according to the invention that careful and controlled cooling of the "as cast" aluminum, usually in coil form, enables one to achieve excellent grain refinement and structure on initial cooling of the material. This not only prevents the need for formally homogenize to refine the structure but also provides substantial energy savings in obviating the need to use energy in heating the aluminum in a formal homogenization process.

Aluminum products produced as a result of the inventive controlling cooling process unexpectedly exhibit higher tensile strength and a greater spread between tensile and yield strengths than cast material which has been allowed to cool without control. The spread between the tensile and yield strength in an important parameter in the production of aluminum foil as it provides strength to the foil. A high tensile strength and a corresponding low yield strength are needed to produce a high strength foil which does not exhibit "tinniness."

Figure 1:
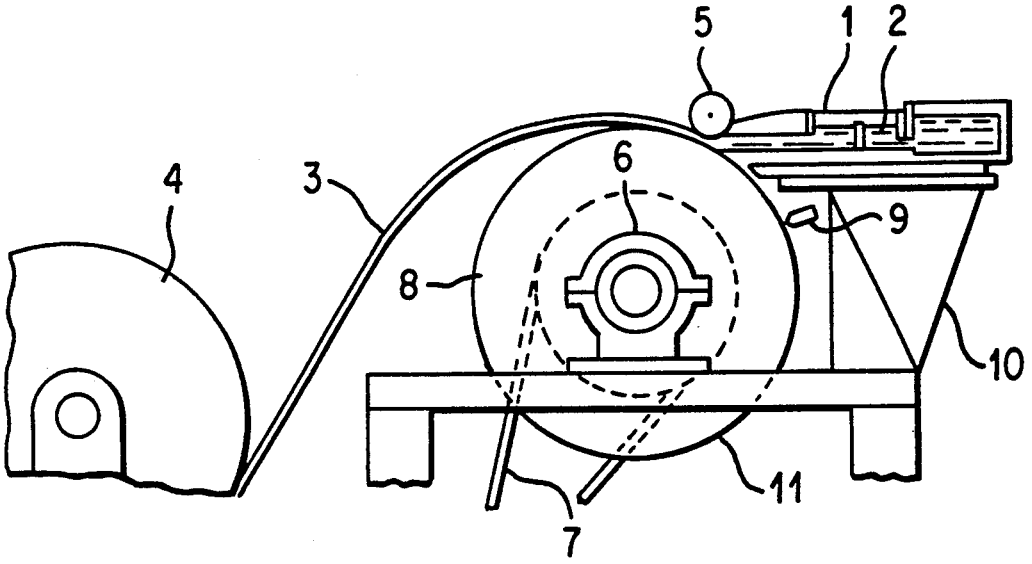
FIG. 1 PRIOR ART
FIG. 1 is a schematic diagram of an aluminum alloy direct casting apparatus.

As noted above, the present invention is primarily concerned with a coil of aluminum which has been cast from a direct casting process. The direct casting of metal strip is known in the prior art as shown, for example, in U.S. Pat. No. 4,828,012 and other prior art mentioned above. In general, this process and apparatus therefor is shown in FIG. 1. In this direct casting method and apparatus, tundish 1 is located in close proximity to a chill surface 11 of a casting wheel upon which molten aluminum is solidified as strip 3. The molten aluminum 2 is withdrawn as strip 3 from the casting apparatus and coiled in a conventional manner on coiler 4. The chill surface 11 which comprises the external cylindrical surface of a casting wheel 8 is internally cooled with circulating water or other cooling liquid to rapidly extract heat from the chill surface 11 and solidify molten metal 2 provided by the tundish which contacts the chill surface as the casting wheel rotates through the molten metal. The chill surface 11 is generally grooved and suitable means such as journal bearings 6 support the casting wheel for rotation about a fixed horizontal axis on a rigid supporting frame 10. Suitable drive means such as a variable speed motor and reduction gear mechanism and a drive chain or belt 7 are also provided in a conventional manner. The exit end of the tundish is located in close proximity to the chill surface 11 and molten metal from the tundish is flowed along the transverse lift into contact with the moving chill surface.

As a result of this operation, the molten aluminum is converted into a metal strip and coiled on coiler 4 at a very high temperature, usually in the range of about 900° F. The aluminum coil contained on coiler 4 is referred to herein as "direct cast aluminum coil." The temperature of this direct cast aluminum coil at the time of being wound on the coiler 16 is in the range of about 900° F. However, it should be noted that variations on this process will produce aluminum coil at varying elevated temperatures so that the expression "in the range of about 900° F." is considered to encompass all such variations in temperature of the aluminum coil.

In accordance with the present invention, it has been discovered that the direct but controlled cooling of the aluminum at a rate of 5° F. per hour to about 90° F. per hour of a drag cast coil of aluminum eliminates formal homogenizing of this coil but still achieves desired grain refinement. By this is meant that the roll does not have to be reheated in accordance with standard homogenization treatments known to aluminum treatments of the art.

A formal homogenization of the coil would normally be deemed necessary to grow the grain refinement constituents of the aluminum alloy, such as iron and silicon, to the proper size, distribute the elements to key disclocations, and to induce complete recrystallization at a final gauge annealing temperature, usually in the range of about 600° F. Without the thermal or formal homogenization, an "as drag cast" coil of aluminum rolled to final gauge would need a temperature of about 700° F. to recrystallize. The method of this invention thus provides substantial advantages in procedure and energy savings by elimination of these formal homogenization treatments.

Normal cast temperature of a drag cast aluminum coil is about 900° F., as indicated above. According to this invention, it has been discovered that if this temperature can be maintained for a longer period of time by controlled slow cooling, the cost of a formal thermal treatment elsewhere in its fabrication processing can be eliminated. This results in substantial economic savings and ecological advantages.

The method of the invention may be carried out using any desirable apparatus. It is only necessary that the coil of aluminum be in a controlled atmosphere so as to achieve the desired slow cooling effect. A preferred procedure is to maintain the aluminum coil in a temperature sensitive chamber such as a "hot box" in which heat removal can be controlled as desired to the preferred cooling rate. For example, an insulated chamber capable of reducing heat loss below the minimum cooling rate can be employed. A circulating fan with by-pass capability for entry and exit of atmosphere in the chamber is incorporated into the device. The by-pass dampers are controlled by a programmable controller connected to a thermocouple in direct contact with the coil. As the rate of cooling changes, as reflected by the thermocouple temperature reading, the controller varies the damper positions to control external atmosphere intake. A fan circulates the chamber atmosphere continuously during the cooling process. External heat sources may or may not be applied as required to achieve the desired cooling rate. The optimum preferred cooling rate is 10° F. per hour to 40° F. per hour.

Figure 2:
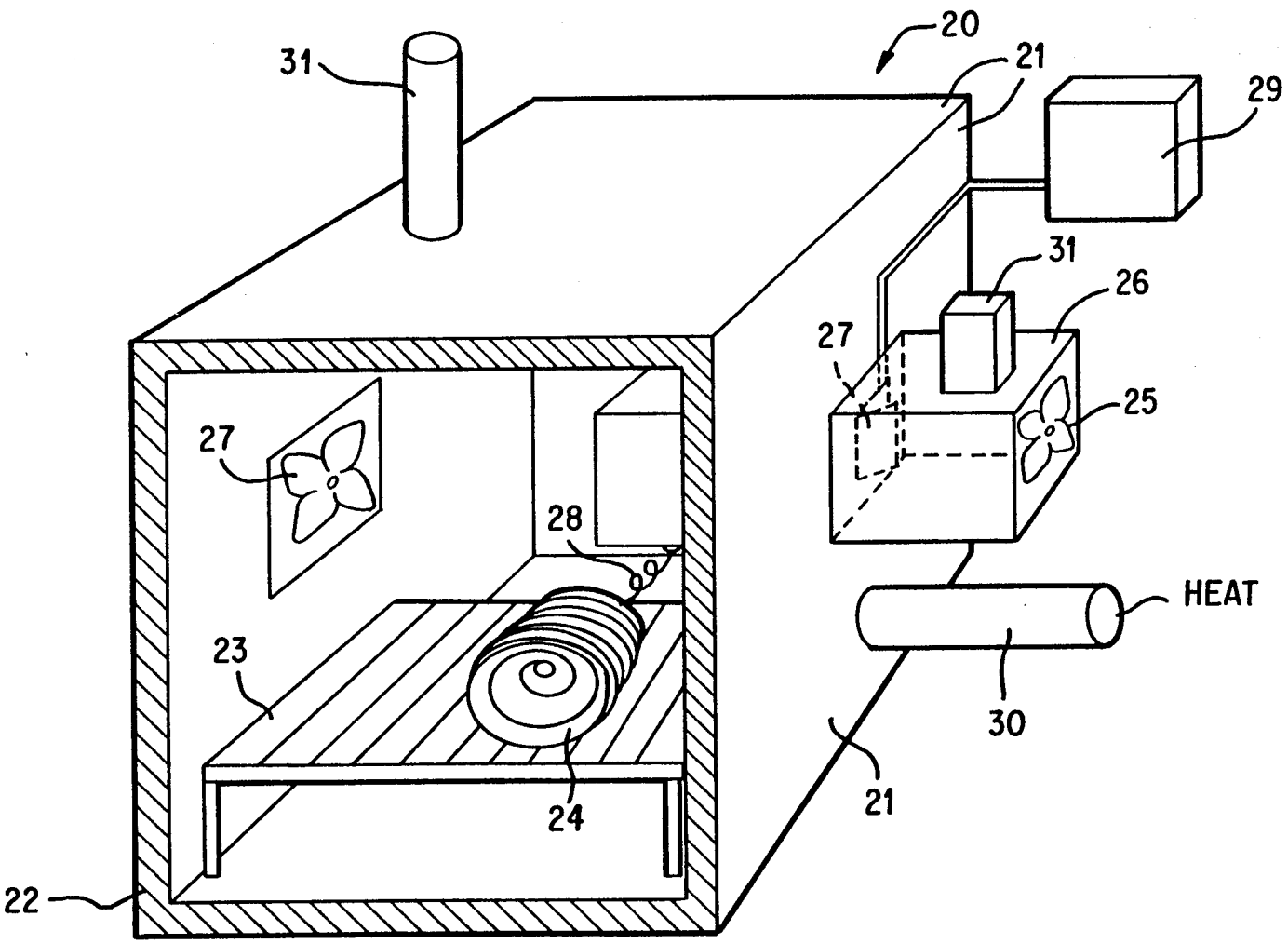
FIG. 2 is an elevational view of an apparatus for carrying out the invention.

A suitable cooling chamber is illustrated in an elevation view in FIG. 2. This cooling chamber is a temperature sensitive chamber 20 which comprises a housing having sides 21 and insulated at 22. An aluminum coil 24 is transferred to the chamber and placed on a shelf 23 within the temperature sensitive chamber. Air circulating means are provided by fan 25 connected to the atmosphere through conduit 26 to circulate air within the chamber on a controlled basis with the introduction of air to the chamber being by damper 27. The atmosphere of the temperature sensitive chamber is preferably maintained in circulation as by fan 27. The thermocouple 28 which touches the aluminum coil senses the temperature of the coil, and this information is transmitted to controller 29 which in turn controls the opening or closing of damper 27 to introduce air into the chamber as needed to maintain the correct cooling rate. When the air needs to be reduced or shut off completely into the chamber, the air drawn in by fan 25 can be removed through vent 31. Thus controller 29 controls the damper 27 to introduce air drawn in by fan 25 as necessary to control the temperature. If cooling occurs too quickly, external heat could be introduced at 30. The chamber is vented at 31.

In general, a cooling chamber of this type would be about 10 feet by 12 feet by 10 feet tall and will have curtain type or solid doors. Coils of the hot foil 24 are transported to and placed on racks or shelves inside the chamber. When cooling to the desired temperature is completed, the coil may be removed for further working.

In additional preferred embodiments of the invention, the aluminum coil in the "as cast" form will generally have a product or strip thickness in the range of about 0.040" to 0.055" thickness, and preferably a thickness of 0.052".

After cooling of the aluminum coil, it is then preferred to mechanically work the aluminum strip by cold rolling to a thickness in the range of about 0.0006" to 0.006", preferably 0.004". One of the desirable products resulting from the method of the present invention is aluminum foil which in its commercial embodiment will have a thickness of about 0.004".

Optionally, it may also be desirable to further process the cold rolled material by annealing, such as heating for an additional period of time to achieve the annealing effect and final grain structure to meet commercial specifications. A suitable annealing treatment is to heat the coil to a temperature of 600° F. -800° F. for 1-3 hours.

The aluminum used in the present invention is preferably an aluminum alloy which contains grain refinement constituents. A preferred aluminum alloy would contain iron and silicon and preferably a greater amount of iron than silicon, with each component being present in amounts of less than about 1 wt. %.

The following examples are presented to illustrate the invention. However, it is not to be considered as limited thereto, as obvious variations thereon will become apparent to those skilled in the art. In the following examples, parts are by weight unless otherwise indicated.

EXAMPLE 1

In this example, six lots of an aluminum alloy containing 0.66 wt. % iron and 0.55 wt. % silicon were cast from a drag casting process as 0.052" gauge strip and then cold rolled to a final gauge of 0.004" using the following identification and thermal practices. This example is a simulated example to compare various cooling rates. Because it is a simulated example, it was necessary to heat the coil to 900° F. and then cool at different cooling rates to determine the effect on properties.

TABLE I

#3A) 0.052", No Thermal treatment, CR to 0.004", Ann. 2 Hrs. @ 600° F.
#3B) 0.052", No Thermal treatment, CR to 0.004", Ann. 2 Hrs. @ 700° F.
#4A) 0.052", Heat to 900° F. (NH), Cool 40° F./Hr., CR to 0.004", Ann. 2 Hrs. @ 600° F.
#4B) 0.052", Heat to 900° F. (NH), Cool 40° F./Hr., CR to 0.004", Ann. 2 Hrs. @ 700° F.

TABLE I-continued

#5A) 0.052", Heat to 900° F. (NH), Cool 30° F./Hr., CR to 0.004", Ann. 2 Hrs. @ 600° F.
#5B) 0.052", Heat to 900° F. (NH), Cool 30° F./Hr., CR to 0.004", Ann. 2 Hrs. @ 700° F.
#6A) 0.052", Heat to 900° F. (NH), Cool 25° F./Hr., CR to 0.004", Ann. 2 Hrs. @ 600° F.
#6B) 0.052", Heat to 900° F. (NH), Cool 25° F./Hr., CR to 0.004", Ann. 2 Hrs. @ 700° F.
#7A) 0.052", Heat to 900° F. (NH), Cool 20° F./Hr., CR to 0.004", Ann. 2 Hrs. @ 600° F.
#7B) 0.052", Heat to 900° F. (NH), Cool 20° F./Hr., CR to 0.004", Ann. 2 Hrs. @ 700° F.
#8A) 0.052", Heat to 900° F. (NH), Cool 10° F./Hr., CR to 0.004", Ann. 2 Hrs. @ 600° F.
#8B) 0.052", Heat to 900° F. (NH), Cool 10° F./Hr., CR to 0.004", Ann. 2 Hrs. @ 700° F.

CR = Cold Rolled
(NH) = No Hold
75° F./Hr. (Up/Down) heating rate used for all anneals.
1 Sample was sheared from each of the 3 sample blanks submitted per lot.
All samples were tested in the longitudinal grain direction.

The materials from Table I were then subjected to mechanical tests including tensile strength, yield strength, elongation and Mullen, and this data is presented in the following Table 2.

TABLE II

| Identification — | Tensile Strength (ksi) | Yield Strength (ksi) | Elongation (%) | Mullen (psi) |
|---|---|---|---|---|
| #3A* | 20.7 | 20.3 | 2.2 | 48.4 |
| #3B | 13.8 | 6.2 | 20.7 | 51.6 |
| #4A | 13.5 | 7.1 | 17.1 | 36.2 |
| #4B | 13.5 | 5.4 | 21.0 | 43.6 |
| #5A | 13.7 | 7.6 | 20.7 | 36.2 |
| #5B | 13.7 | 5.3 | 18.0 | 44.2 |
| #6A | 13.4 | 6.7 | 22.6 | 44.8 |
| #6B | 13.9 | 5.4 | 22.1 | 43.8 |
| #7A | 13.4 | 6.3 | 23.3 | 43.2 |
| #7B | 13.4 | 5.0 | 20.9 | 47.2 |
| #8A | 13.2 | 6.1 | 20.5 | 47.4 |
| #8B | 13.3 | 5.2 | 20.7 | 48.4 |

*Without a thermal treatment, the material was not dead soft; e.g., the material did not recrystallize with a 600° final anneal.

As may be noted from the mechanical property tests set forth above, the best results are achieved from samples 6B, 7B and 8B which show the criticality of the cooling rate of 10° F. to 25° F. per hour. The drawings of FIGS. 3, 4, 5, 6, 7 and 8 are photomicrographs of the samples of Tables 1 and 2 which include samples 3A and 3B, 4A and 4B, 5A and 5B, 6A and 6B, 7A and 7B, and 8A and 8B.

Figure 3A:
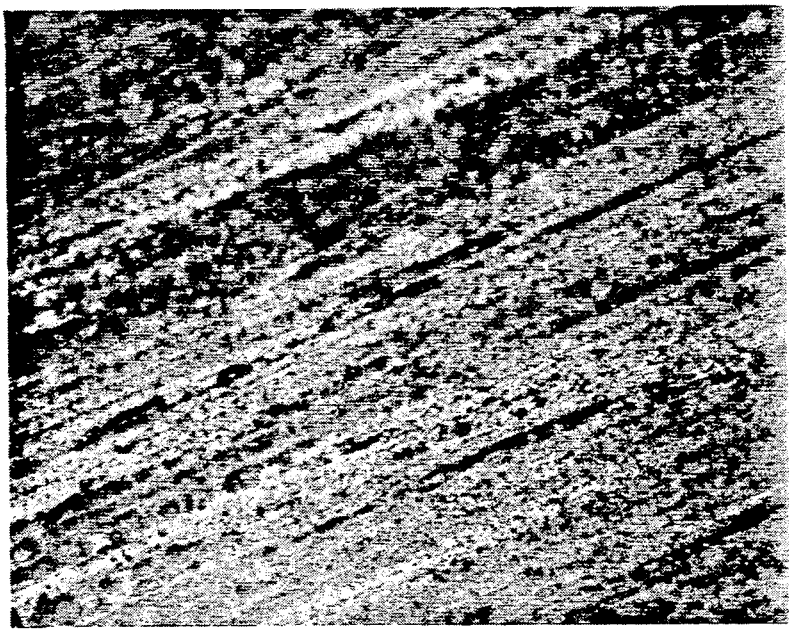
FIGS. 3A, 3B, 4A, 4B, 5A, 5B, 6A, 6B, 7A, 7B, 8A, and 8B are photomicrographs of the sample products produced in accordance with Example 1 of the application.
Figure 3B:
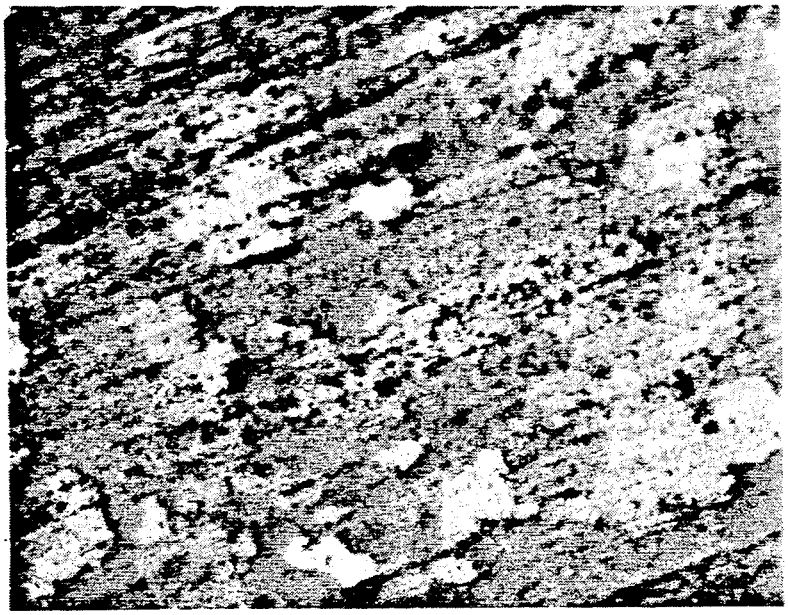

In the accompanying drawings, FIG. 3 is photomicrographs of samples 1A and 1B with no controlled cooling from cast gauge showing the grain structure at 0.0015" after final anneals of (A) 600° F. and (B) 700° F.

Figure 4A:
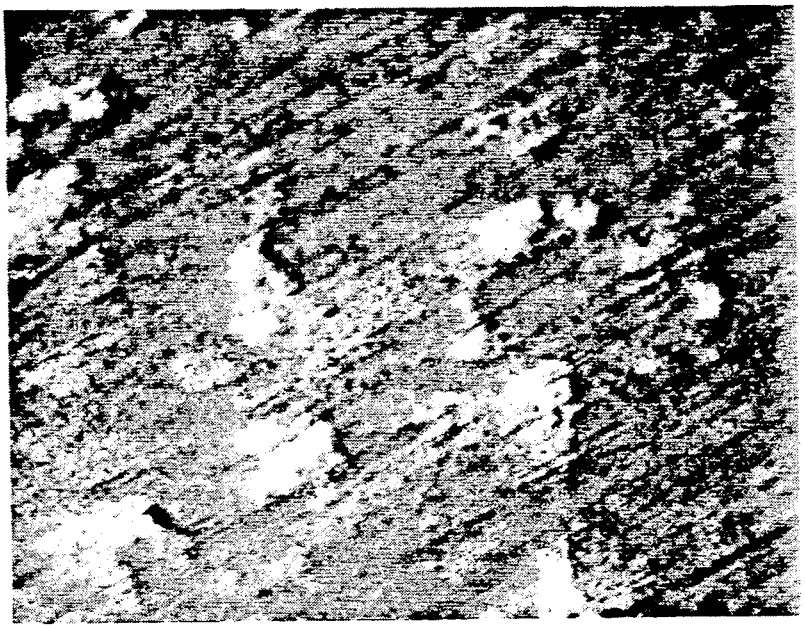
Figure 4B:
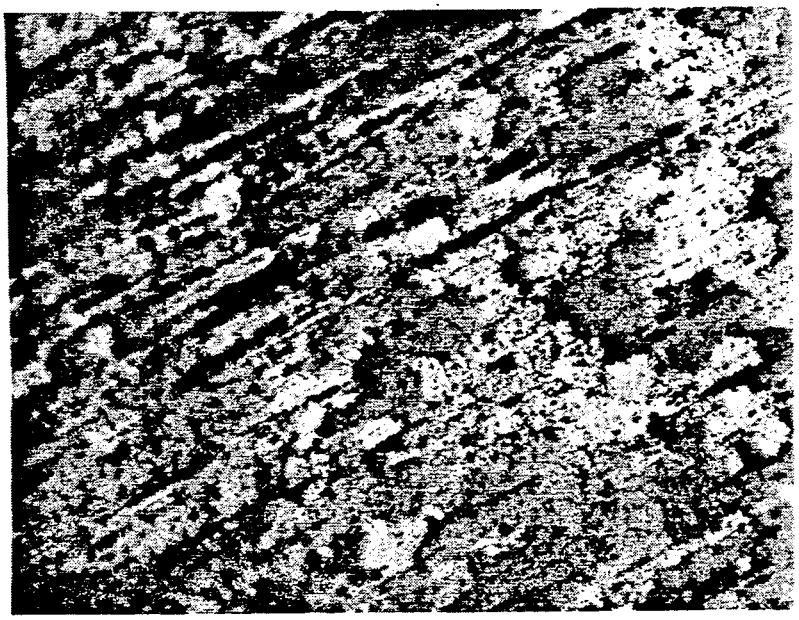

FIG. 4 is a photomicrograph of samples 4A and 4B cooled at the rate of 40° F. per hour from 900° F. at cast gauge showing the grain structure at 0.0015" after final anneals of (A) 600° F. and (B) 700° F.

Figure 5A:
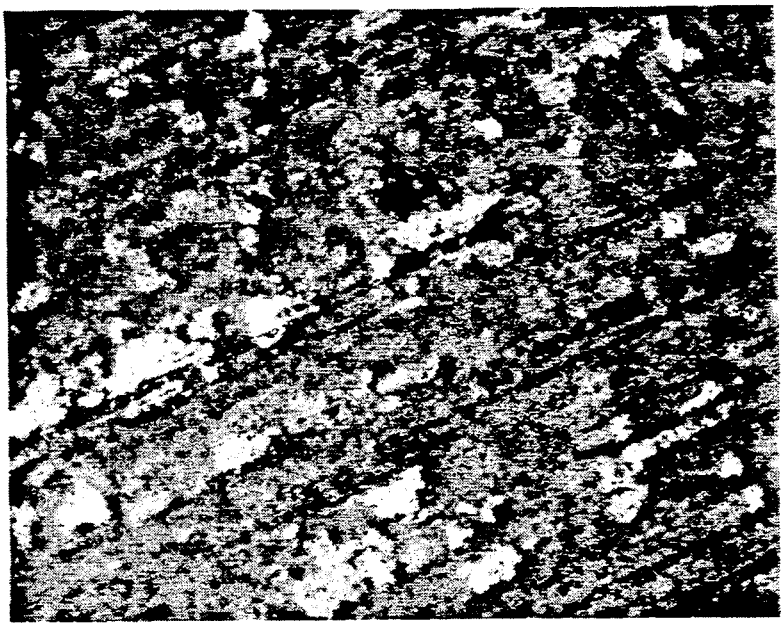
Figure 5B:
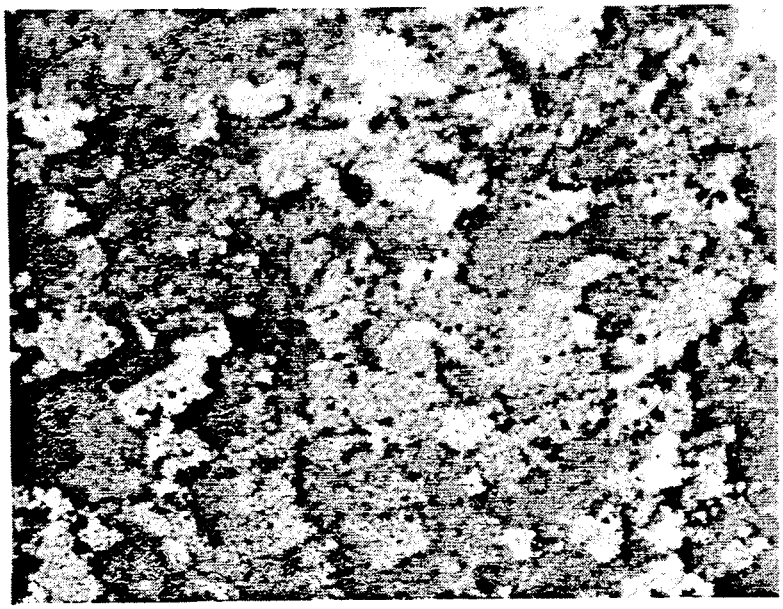

FIG. 5 is a photomicrograph of samples 5A and 5B cooled at the rate of 30° F. per hour from 900° F. and showing the grain structure at 0.0015" after final anneals of 600° F. and 700° F.

Figure 6A:
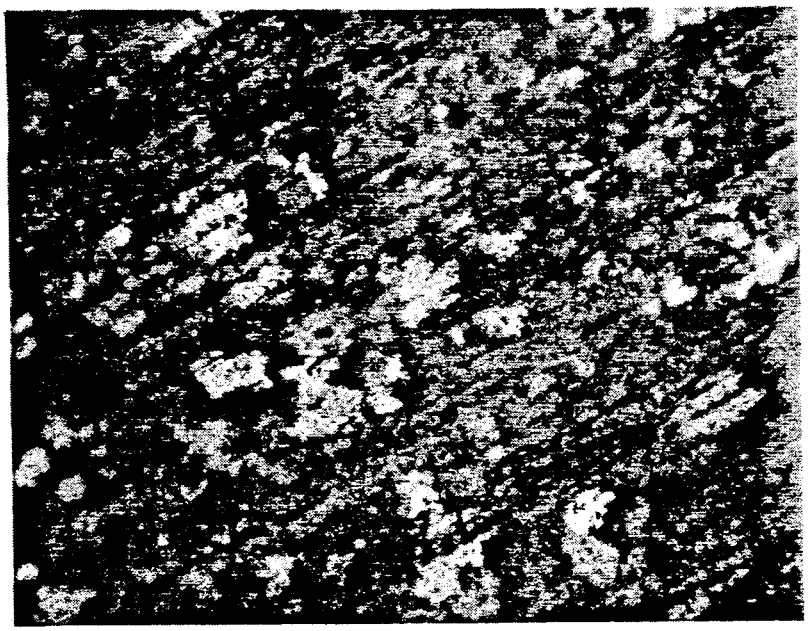
Figure 6B:
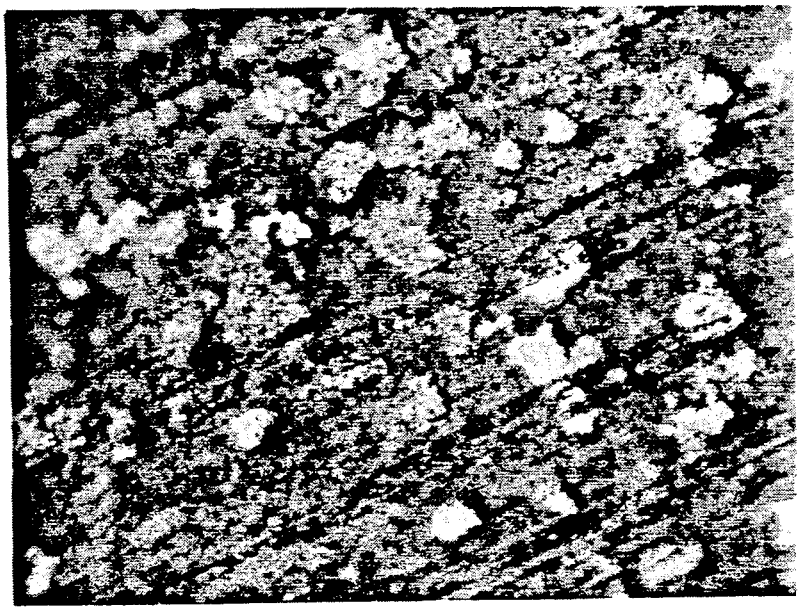
Figure 7A:
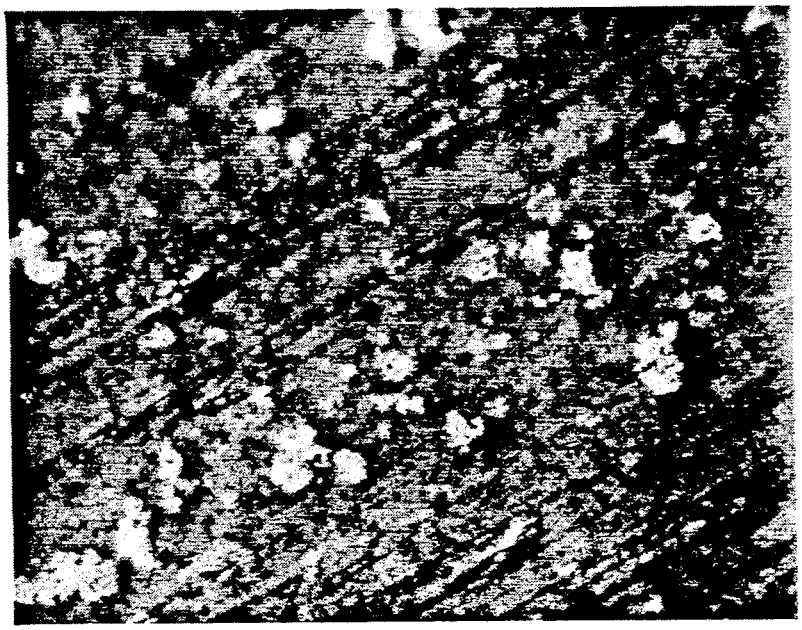
Figure 7B:
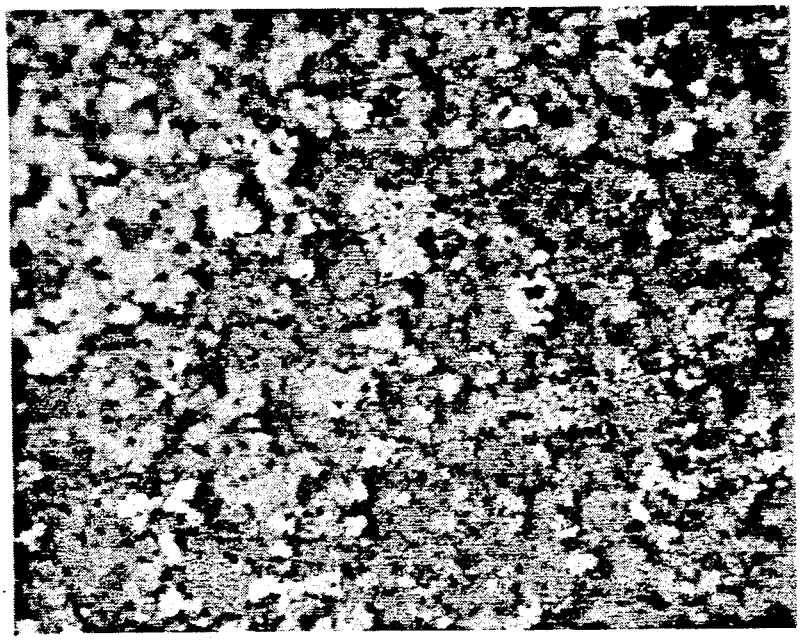
Figure 8A:
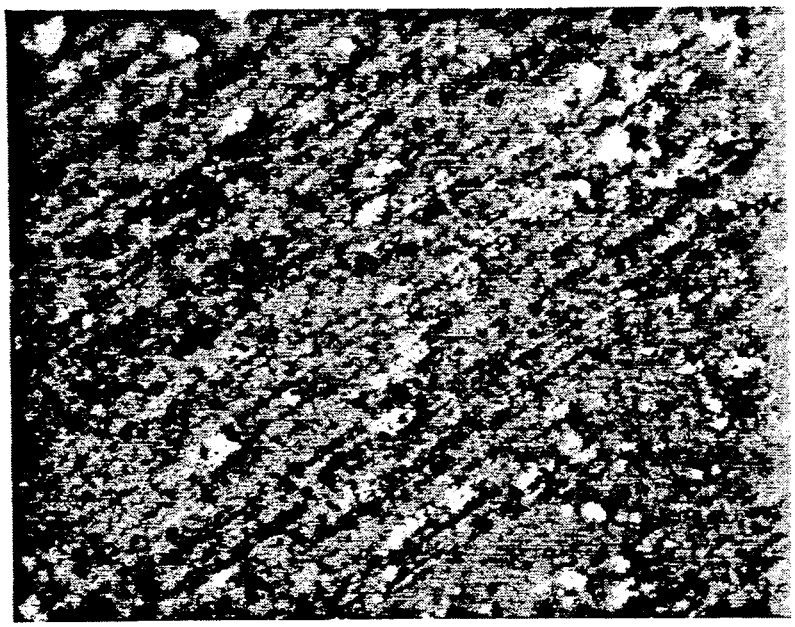
Figure 8B:
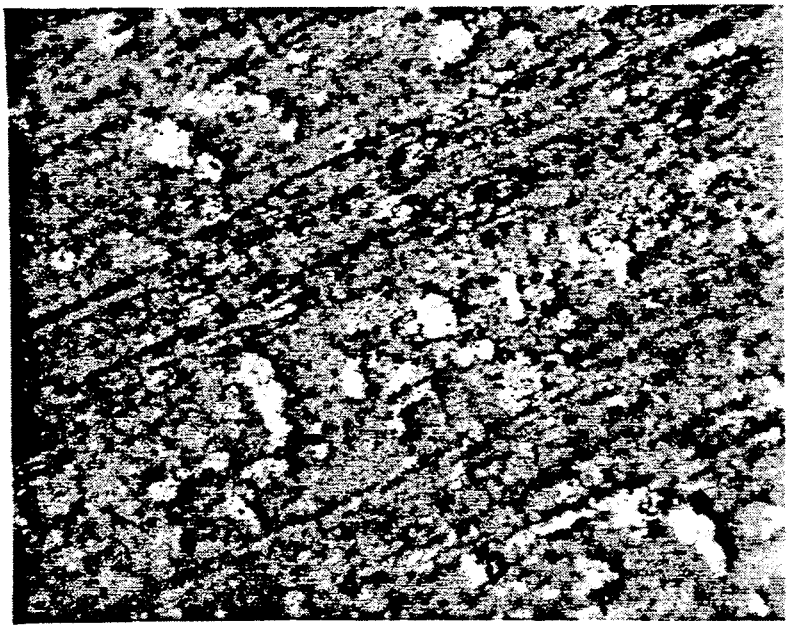

FIG. 6 is photomicrographs of samples 6A and 6B cooled at the rate of 25° F. per hour under the same conditions as FIGS. 3, 4 and 5. FIG. 7 is photomicrographs of samples 7A and 7B cooled at the rate of 20° F. per hour under the same conditions. FIG. 8 is a photomicrograph of samples 8A and 8B cooled at the rate of 10° F. per hour under the same conditions. In all of these figures, magnification is at the rate of 100X.

As may be seen, these photomicrographs demonstrate that the best grain structure is obtained from samples 6B, 7B and 8B. The other samples, however, are all substantially improved over samples 3A and 3B.

EXAMPLE 2

In this example, three different homogenizing treatments were applied to samples of an aluminum coil of Example 1 from a drag casting process to produce properties and a microstructure which approaches commercial specifications for an aluminum foil.

As shown in Table III, A depicts results from an in-line homogenization process, and B and C depict results from a formal, or conventional, homogenization process. All three homogenizing treatments produced higher properties than those obtained by normal procedures. The spread between the tensile strength and yield strength was also larger in the drag cast metal. This large spread is desirable in that it produces a high strength foil without the often accompanying "tinniness."

This is a simulated example in which aluminum coil of the same characteristics of Example 1, which has been previously cooled to room temperature is heated in a hot furnace to 900° F. and then, with no hold time, cooled at 15° F./hr. The aluminum employed in this example was an "as cast" aluminum alloy having a thickness of 0.052" and where the alloy contains 0.66 wt. % iron and 0.55 wt. % silicon.

As shown in Table III below, the samples were given the following treatments:

A) Run A, "as cast coil" (0.052"), placed in hot 900° F. furnace and cooled 15° F./hr. with no hold.

B) Run B, "as cast coil" (0.052"), homogenized 8 hrs./900° F. with a heating and cooling rate of 75° F./hr.

C) Run C, "as cast coil" (0.052"), cold rolled to 0.020", homogenized 8 hrs./900° F. with a heating and cooling rate of 75° F./hr.

Samples from each of the three lots were then cold rolled to 0.004" (for mechanical properties) or 0.0015" (for Mullen tests) and given a final anneal of (1) 600° F. or (2) 700° F. for 2 hours with a heating and cooling rate of 75° F./hr. The results are shown in Table III.

In a further test, an aluminum coil of Run A was compared to an aluminum coil (P) of similar chemistry using plant processing and thermal methods now in use. The plant coil was produced by the roll cast method.

The samples were given the following treatments:

A) Run A, "as cast coil" (0.052"), (200 ft./min.=600 lb./in./hr.), placed in hot 900° F. furnace and cooled 15° F./hr. with no hold.

B) Run P, plant coil cast (SCAL twin-roll caster) at 0.400" (40"/min.=100 lb./in./hr.), cold rolled to 0.042", annealed for 4 hours at 850° F. at a heating and cooling rate of 75° F./hr.

Samples from each of the two lots were then cold rolled to 0.004" (for mechanical properties) or 0.0015" (for Mullen tests) and given a final anneal of (1) 600° F. or (2) 700° F. for 2 hours with a heating and cooling rate of 75° F./hr.

Mechanical properties were determined from material at 0.004" gauge, and Mullen values were determined from samples at 0.0015". The results were as follows, as shown in Table III.

TABLE III

| Identification | Tensile (ksi) | Yield (ksi) | Elongation (%) | Mullen (psi) |
|---|---|---|---|---|
| A-1 | 13.4 | 5.6 | 22.3 | 60.6 |
| 2 | 13.5 | 5.1 | 21.0 | 59.4 |
| B-1 | 13.5 | 5.2 | 24.6 | 58.6 |
| 2 | 13.4 | 5.0 | 23.1 | 56.2 |
| C-1 | 12.8 | 4.7 | 23.5 | 51.5 |
| 2 | 13.0 | 4.7 | 22.3 | 53.6 |
| P-1 | 12.2 | 4.8 | 21.8 | 52.1 |
| 2 | 12.3 | 4.7 | 19.1 | 50.7 |

As may be seen from the results of these examples, the drag cast material which was slowly cooled had consistently higher tensile properties than those of the plant coil. The spread between the tensile and yield strength is also an important parameter in foil production. A "high" tensile strength and a corresponding "low" yield strength are needed to produce a high strength foil without "tinniness." The drag cast foil typically had a higher spread than did the plant foil.

The invention has been described with reference to certain preferred embodiments. However, as obvious variations will become apparent to those skilled in the art, the invention is not to be considered as limited thereto.

What is claimed is:

1. A method for grain refinement of aluminum contained in a coil of aluminum which comprises:

a) drag casting aluminum from an aluminum melt at an elevated temperature onto a single chilled surface to form an aluminum casting;

b) removing the aluminum casting from the chilled surface, coiling the as cast aluminum onto a coiler at a casting temperature of about 900° F., and c) without heating said as cast aluminum, slowly cooling said as cast aluminum from said temperature under controlled conditions at a cooling rate ranging from about 5° F. per hour to 90° F. per hour to produce said coil of aluminum which has excellent grain refinement, high tensile strength and an increased spread between tensile strength and yield strength.

2. A method according to claim 1 wherein the aluminum is an alloy of aluminum.

3. A method according to claim 2 wherein the alloy contains silicon and iron with the balance aluminum.

4. A method according to claim 1 wherein the cooling rate ranges from about 10° F. per hour to about 75° F. per hour.

5. A method according to claim 1 wherein the aluminum coil is cooled within a temperature sensitive chamber to control said cooling rate.

6. A method according to claim 5 wherein external heat is introduced into said temperature sensitive chamber to control the cooling effect.

7. A method according to claim 1 wherein said cooled aluminum coil is then cold rolled after cooling.

8. A method according to claim 7 wherein the coil is annealed after cold rolling by heating the coil to a temperature of 600° F.-800° F. for 1-2 hours.

9. A method according to claim 1 wherein the cooling rate is at a temperature of about 10° F. per hour to 40° F. per hour and the spread between tensile strength and yield strength is at least 8.1 ksi.

10. Refined aluminum alloy produced according to the method of claim 9.

11. A method for grain refinement of aluminum alloy contained in a coil of an aluminum alloy to upgrade the quality of the aluminum alloy, which comprises:

a) drag casting the aluminum alloy from an aluminum alloy melt at an elevated temperature onto a single chilled surface to form an aluminum alloy casting;

b) removing the aluminum alloy casting from the chilled surface, coiling the as cast aluminum alloy onto a coiler at a casting temperature of about 900° F.;

c) without heating said as cast aluminum, slowly cooling said as cast aluminum alloy from said temperature under controlled conditions at a cooling rate ranging from about 10° F. per hour to 75° F. per hour to ambient temperature;

d) cold rolling the cooled aluminum alloy from step c);

e) annealing said cold rolled aluminum alloy by heating to a temperature of about 600° F. to 800° F. for 1–2 hours; and f) cooling the annealed aluminum alloy.

12. A method according to claim 11 wherein the cooling rate in step c is about 10° F. per hour to 40° F. per hour.

* * * * *